US010814173B2

(12) United States Patent
Norton

(10) Patent No.: US 10,814,173 B2
(45) Date of Patent: Oct. 27, 2020

(54) CLIMBING ROPE PROTECTOR DEVICE AND METHOD OF USING SAME

(71) Applicant: Peak Performance Leadership, LLC, Killingworth, CT (US)

(72) Inventor: Jonathan T. Norton, Killingworth, CT (US)

(73) Assignee: PEAK PERFOMANCE LEADERSHIP, LLC, Killingworth, CT (US)

( * ) Notice: Subject to any disclaimer, the term of this patent is extended or adjusted under 35 U.S.C. 154(b) by 0 days.

(21) Appl. No.: 16/229,879

(22) Filed: Dec. 21, 2018

(65) Prior Publication Data

US 2019/0111320 A1 Apr. 18, 2019

Related U.S. Application Data

(63) Continuation of application No. 15/705,993, filed on Sep. 15, 2017, now Pat. No. 10,213,649.

(60) Provisional application No. 62/395,459, filed on Sep. 16, 2016.

(51) Int. Cl.
*A63B 29/02* (2006.01)

(52) U.S. Cl.
CPC ..... *A63B 29/028* (2013.01); *A63B 2209/08* (2013.01); *A63B 2209/10* (2013.01); *D07B 2201/2083* (2013.01)

(58) Field of Classification Search
CPC ..... A63B 29/028; D07B 2201/2083; D07B 2401/2065; D07B 2801/22
See application file for complete search history.

(56) References Cited

U.S. PATENT DOCUMENTS

| | | | |
|---|---|---|---|
| 4,402,489 | A | 9/1983 | Murray |
| 4,930,543 | A | 6/1990 | Zuiches |
| 5,226,456 | A | 7/1993 | Semak |
| 5,535,787 | A | 7/1996 | Howell |
| 8,153,228 | B2 | 4/2012 | Holland et al. |
| 8,502,069 | B2 | 8/2013 | Holland et al. |
| 8,752,590 | B2 | 6/2014 | Petty et al. |
| 2002/0170727 | A1 | 11/2002 | Holland et al. |
| 2011/0272654 | A1 | 11/2011 | Fay et al. |
| 2016/0279477 | A1 | 9/2016 | Petty et al. |

OTHER PUBLICATIONS

Petzl, PROTEC: Flexible Protection, 1 page, (Viewed Nov. 8, 2016) https://petzl.com/LU/en/Professional/Ropes/PROTEC#.WDOV17lrLIU.

DMM International, Rope Protector, 1 page, (Viewed Nov. 8, 2016) http://dmmprofessional.com/products/rope-protector.

Lyon Equipment Limited, Lyon Canvas Rope Protector, Work & Rescue Equipment & Quick Links Price List, p. 39, Effective Jan. 1, 2015, http://www.ropetask.com/files/7014/3616/4959/V4_WR_Lyon_Equipment__Quick_Links_Price_List_JAN_2015.pdf.

Sterling Rope Company Inc., SafeGuard Rope Protector, 2 pages (Viewed Oct. 10, 2017) https://sterlingrope.com/store/work/accessories-swag/rope-care/safgeguard-rope-protector.

*Primary Examiner* — Robert Sandy
*Assistant Examiner* — Michael S Lee

(57) ABSTRACT

Disclosed herein is a device for protecting a climbing rope comprising a flexible sheath comprising a first edge, a second edge generally opposing the first edge, a first end, and a second end generally opposing the first end, a sheath connector assembly attached at the second end of the flexible sheath, and a primary rope connector assembly attached to the sheath connector assembly. Methods of making and using the device also are described.

12 Claims, 18 Drawing Sheets

CLIMBING ROPE PROTECTOR DEVICE AND METHOD OF USING SAME

BACKGROUND

The disclosed embodiments are generally directed to the field of climbing rope safety devices.

Climbing ropes are frequently used to scale or climb mountains and ledges, and are also used to rappel or descend mountains or cliffs. Such ropes, hereinafter referred to as load-bearing ropes, are also used in rescue operations by first responders, in police and fire safety operations and are also used in military operations. Often, such load-bearing ropes are required to pass over sharp-edged rocks, ledges or other objects that can damage a rope. The point where the load bearing rope passes over such a rock or ledge or other object encounters significant forces that can compromise the integrity of the rope with repeated exposure to such forces, ultimately requiring that the rope be retired from further use. Further, such exposure may typically occur at a single location along the length of the load-bearing rope, for example at the beginning of a descent over a ledge, thereby requiring that the rope be retired even though the majority of the length of the rope is intact and secure.

Further, known edge protectors are bulky and unwieldy, making them inconvenient to use, and also inconvenient to store on the person of a climber during an ascent or descent.

From the above, it is therefore seen that there exists a need in the art to overcome the deficiencies and limitations described herein.

SUMMARY

The shortcomings of the prior known devices are overcome and additional advantages are provided through a rope protecting device that is easily adapted to an existing load-bearing rope at the precise point where a rope is encounters stresses associated with an edge. In embodiments, the assembly is lightweight and is easily rolled into a compact configuration when not in use.

One aspect of the disclosed embodiments, is a device for protecting a climbing rope comprising a flexible sheath having a first edge and a second edge generally opposing the first edge, a first end and a second end generally opposing the first end, a sheath connector assembly attached at the second end and a primary rope connector assembly attached to the sheath connector assembly.

In embodiments, a method is provided for manufacturing the device described in the previous paragraph. Furthermore, an assembly is described herein comprising a load-bearing rope and the device described in the previous paragraph.

In some cases, a method of using the device described above comprises: obtaining the device for protecting a climbing rope, obtaining a load-bearing rope, and securing the rope protecting device to the load-bearing rope so that the device is secured between an edge and the load-bearing rope while the rope bears a load.

In some cases, the flexible sheath further comprises a handle positioned at the first end and at least two grommets positioned at the second sheath end.

In embodiments, the flexible sheath further comprises a fastening tape closure along at least a portion of the first and second edges for detachably attaching the first and second edges together, as will be more fully described herein.

In some embodiments, the sheath connector assembly comprises at least two sheath straps each having a first end and a second end, and at least one O-ring. Each sheath strap first end is positioned to pass through a grommet in the flexible sheath. Each sheath strap first end is then attached to the sheath strap. Each strap second end is positioned to pass through the O-ring. Each sheath strap second end is then attached the sheath strap.

In some cases, the primary rope connector assembly further comprises at least one strap having a first end and a second end. The first end of the primary rope connector strap passes through the O-ring and then is attached to the primary rope connector strap. The second end of the primary rope connector strap passes through a gate clip and is then attached to the strap. The primary rope connector assembly further comprises a rope-gripping device attached to the gate clip and positioned to also attach to a load-bearing rope.

Additional features and advantages are realized through the techniques described herein. Other embodiments and aspects of the disclosed embodiments are described in detail herein and are considered a part of the claims.

BRIEF DESCRIPTION OF THE DRAWINGS

The subject matter which is described below is particularly pointed out and distinctly claimed in the concluding portion of the specification. The embodiments described herein, however, both as to organization and method of practice, taken together with the further objects and advantages thereof, may best be understood by reference to the following description taken in connection with the accompanying drawings in which:

DETAILED DESCRIPTION

As used herein, the term "climbing rope protecting device" means a device for protecting a climbing rope that is configured to surround a climbing rope. As used herein, the term "edge protector assembly" refers to a device for protecting a climbing rope that is configured to contact the edge of a structure during use. As used herein, the term "rope connector assembly" means a connector assembly that attaches to a climbing rope.

First Embodiment

Figure 1:
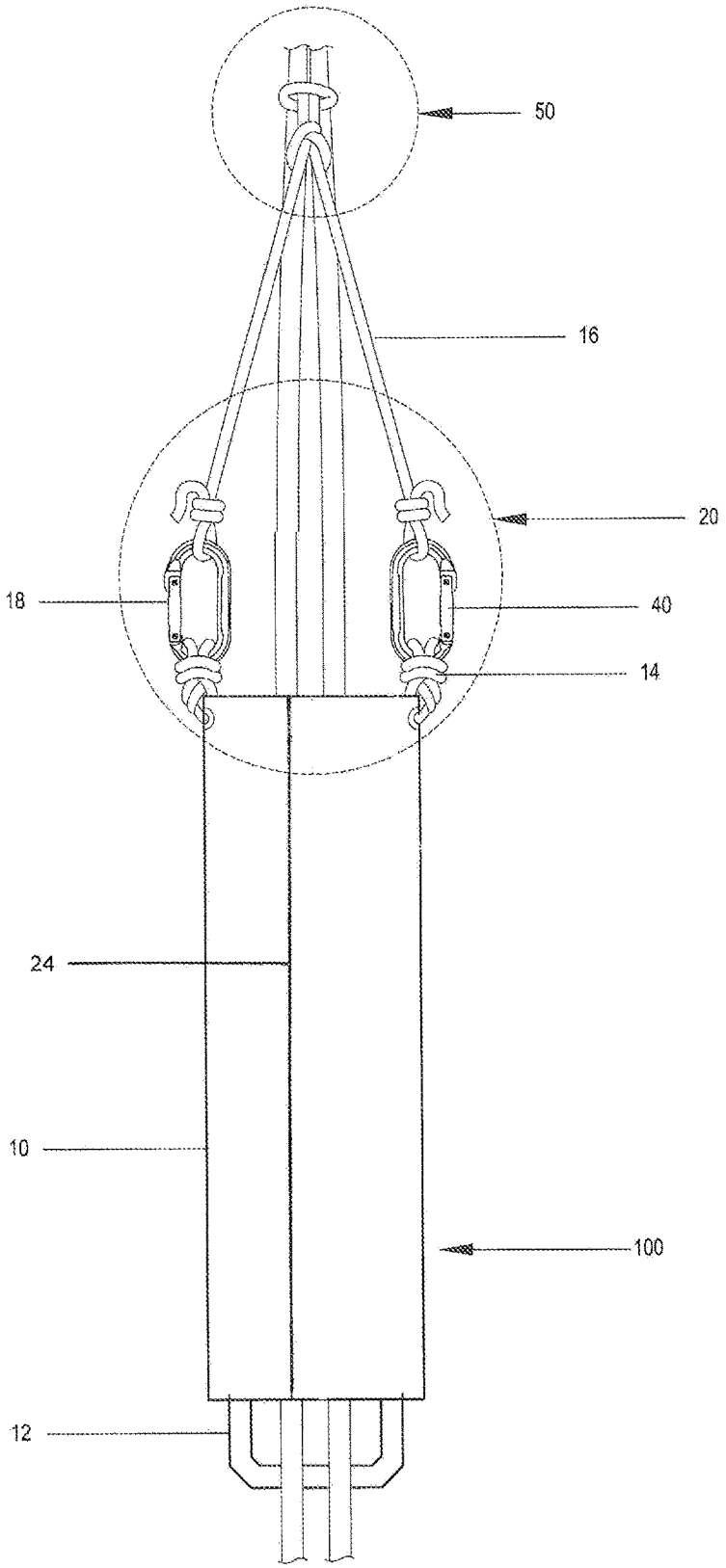
FIG. 1 illustrates an embodiment of the rope protector device described herein.

As shown in FIG. 1, the mountaineering or climbing rope protecting assembly 100, which may function as an edge protector assembly, comprises a flexible sheath 10, a handle 12, a sheath connector assembly 20 and a primary rope connector assembly 16.

Figure 2:
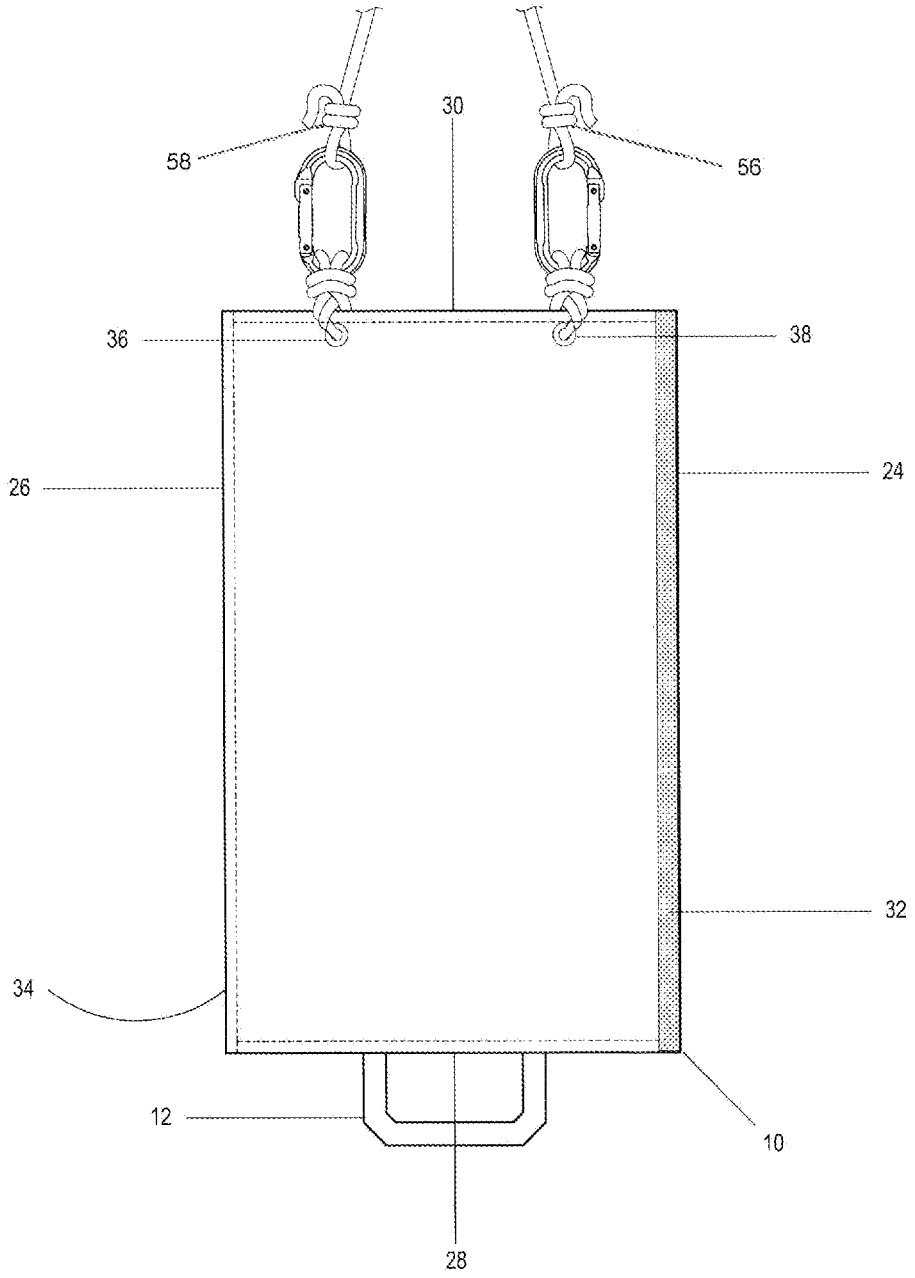
FIG. 2 illustrates the sheath of the rope protector device in an open position.

As can be seen in FIG. 2, the flexible sheath 10 in its open position has a generally rectangular configuration with edges 24 and 26 generally opposed to each other. The flexible sheath is preferably fabricated from a durable, abrasion resistant material. Non-limiting examples of materials that can be used to construct the sheath include, but are not limited to, natural leather, synthetic leather, and durable synthetic and/or natural polymeric material. Non-limiting examples of durable polymeric material include nylon, nylon/cotton blends, and nylon blended with natural fibers. An example of one particularly useful type of material is 1050D Ballistic Fabric sold by Invista under the trade name CORDURA. A non-limiting example of a suitable leather material is such as is available from Tandy Leather Factory as PN 9070-02 Stoned oil side—4/4.5 oz.—dark brown.

Edges 24 and 26 comprise a fastener including a first fastener component 32 and a second fastener component 34 enabling at least a portion of the length of the edges 24 and 26 to be detachably attached to each other. The fastener components 32 and 34 are preferably individually halves of a fastening tape that when used together allow closure for ease of use, although other closing mechanisms can be utilized as are known in the art for attaching and detaching at least a portion of the opposing edges 24 and 26 of the flexible sheath 10. Non-limiting examples of closure devices are buttons, snaps, zippers, hook and eye fasteners or magnetic fasteners. Flexible sheath 10 should be flexible enough to provide an opening large enough for a load bearing rope to pass through the opening created when the fastener halves 32 and 34 are disengaged and the edges 24 and 26 are not attached to each other.

FIG. 2 further illustrates a first sheath end 28, also known as a working sheath end, and second sheath end 30, also known as an anchor sheath end, of the flexible sheath 10. Ends 28 and 30 are generally opposed to each other. A handle 12 is attached at the first sheath end 28, and is preferably fabricated from the same material as the flexible sheath 10. The handle 12 is useful in the operation of the rope protector assembly 100 by allowing the user to pass his hand through the handle while allowing the primary rope to pass through this same hand promoting safe rappelling practices by allowing the rappeler to maintain constant contact with the main climbing rope while positioning and releasing the rope protecting device during the rappel. Further, the handle 12 is also useful in storing the rope protector assembly 100 when not in use. FIG. 2 further illustrates at least two grommets 36 and 38 positioned toward the second sheath end 30. The configuration of the grommets will depend on the nature of the sheath connector assembly 20 as will be more fully disclosed herein.

FIG. 1 illustrates a sheath connector assembly 20 where the sheath 10 is in the closed position, with sheath edges 24 and 26 attached to each other. As shown in FIG. 1, sheath 10 is in the closed position, with sheath edges 24 and 26 attached to each other using fastener components 32 and 34. As shown in FIG. 1, the sheath connector assembly 20 of this embodiment comprises two ropes 14 each having a sheath rope first end and a sheath rope second end. Non-limiting examples of suitable ropes 14 are available as part no. AN05AS0015 from sterlingrope.com. The sheath connector assembly 20 further comprises at least one gate clip 18 such as Omega Pacific, part no. OPD6. In the embodiment shown in FIG. 3, two gate clips 18 and 40 are used. Each sheath rope first end is passed through a grommet 36 or 38 and a gate clip 18 and is then tied to sheath rope second end by way of a figure eight bend knot or other comparable knot used for securing one end of a rope to another end of a rope. Grommets 36 and 38, shown in FIG. 2, each have a separate rope end of a separate rope 14 passing through them but corresponding rope ends may pass though one and the same gate clip 18 if the embodiment only contains one gate clip 18 but not gate clip 40.

As used herein, "gate clip" includes carabiners, both locking and non-locking, or any other ring-type device that has a movable gate feature that allows a strap or rope to be passed through the gate and into the ring from a radial direction in relation to the ring.

Figure 3:
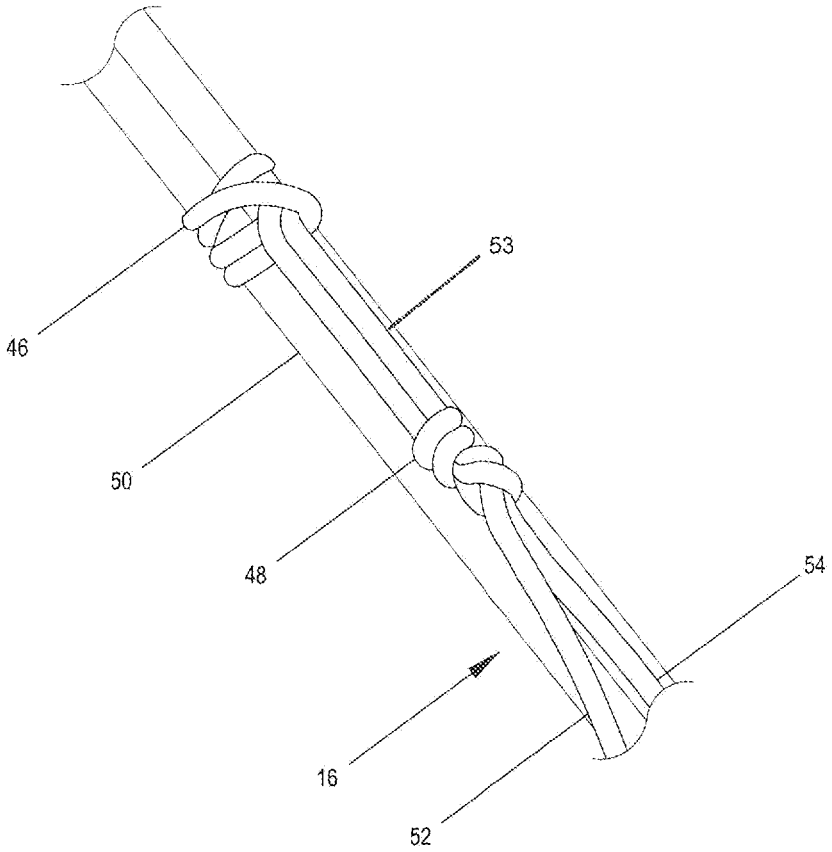
FIG. 3 illustrates a primary rope connector assembly that attaches to the sheath component of the rope protecting device and to the primary rope according to the device of FIG. 1.

FIG. 3 shows a primary rope connector assembly 16. The primary rope connector assembly 16 of this embodiment comprises one or more connector ropes 53 made into legs 52 and 54 that attach to the gate clips 18 and 40, by way of double over hand knots 56 and 58, or comparable knots, and to the load-bearing rope 50 by way of a device positioner such as a prusik knot 46, shown in FIG. 3, or any other suitable device positioner including but not limited to knots commonly suitable for securing ropes axially along another rope. The ropes or legs of the single rope 52 and 54 connecting to the gate clip may be secured to each other by way of double figure eight knot 48 or other comparable knot commonly used for joining two ropes together.

Figure 4A:
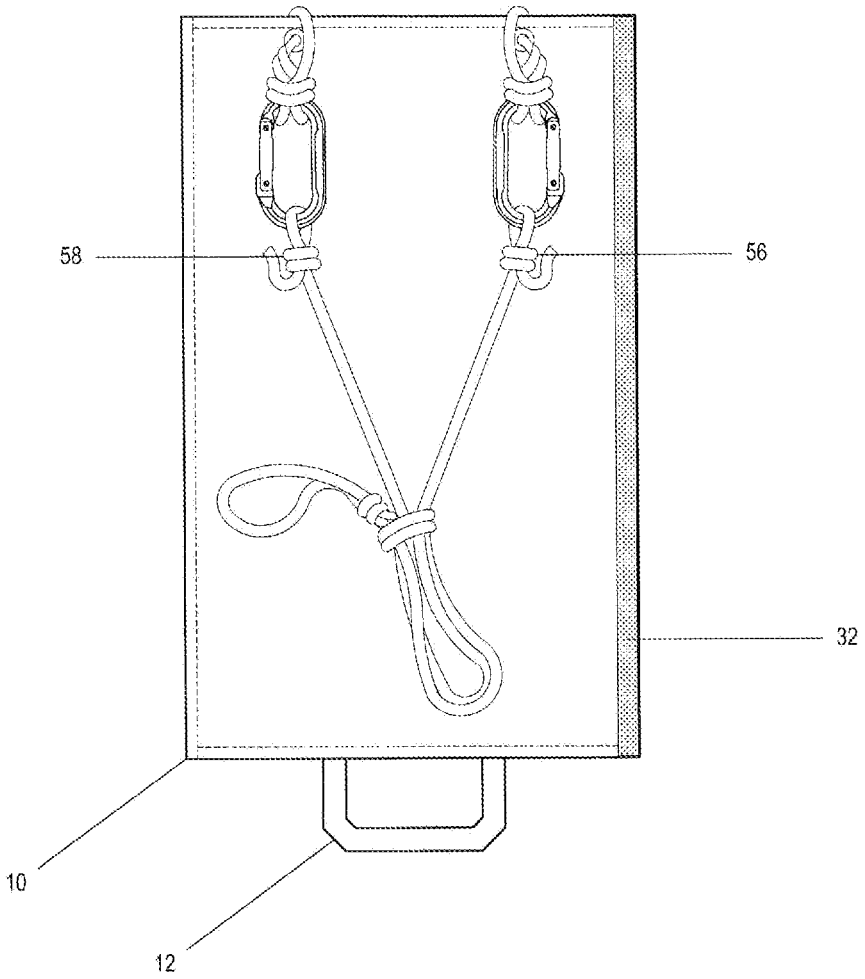
FIG. 4A illustrates the sheath open to show the position of the primary rope connector assembly when the rope protecting device of FIG. 1 is in the storage configuration.
Figure 4B:
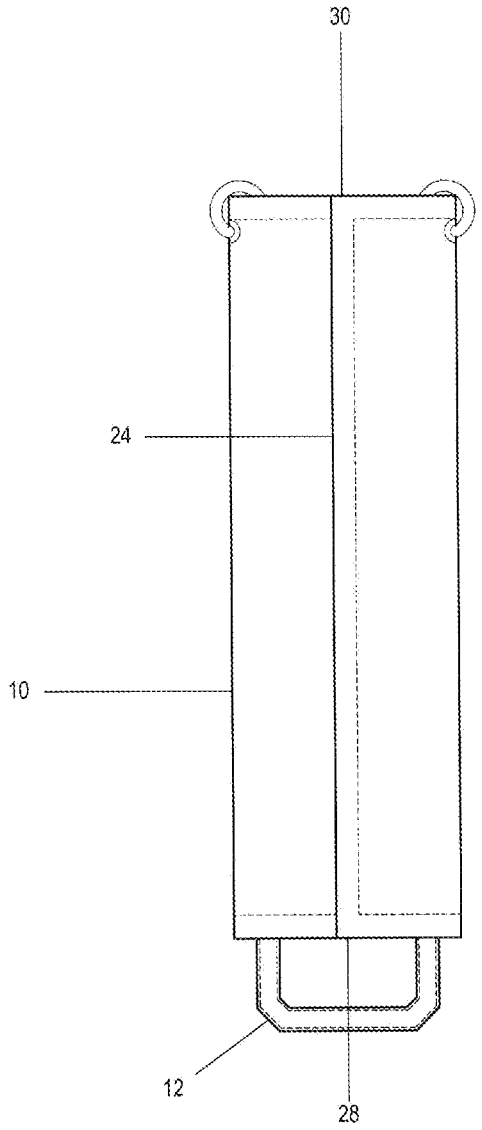
FIG. 4B illustrates the rope protector device of FIG. 1 in a storage configuration according to certain embodiments.
Figure 4C:
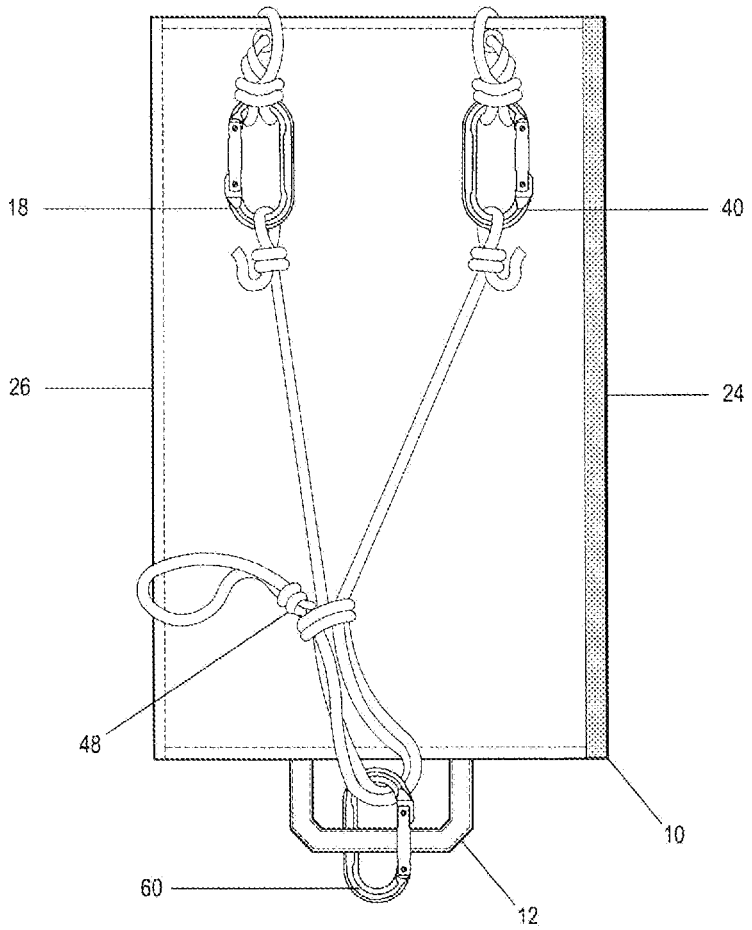
FIG. 4C illustrates the sheath open to show the position of the primary rope connector assembly when the rope protecting device of FIG. 1 is in the storage configuration.
Figure 4D:
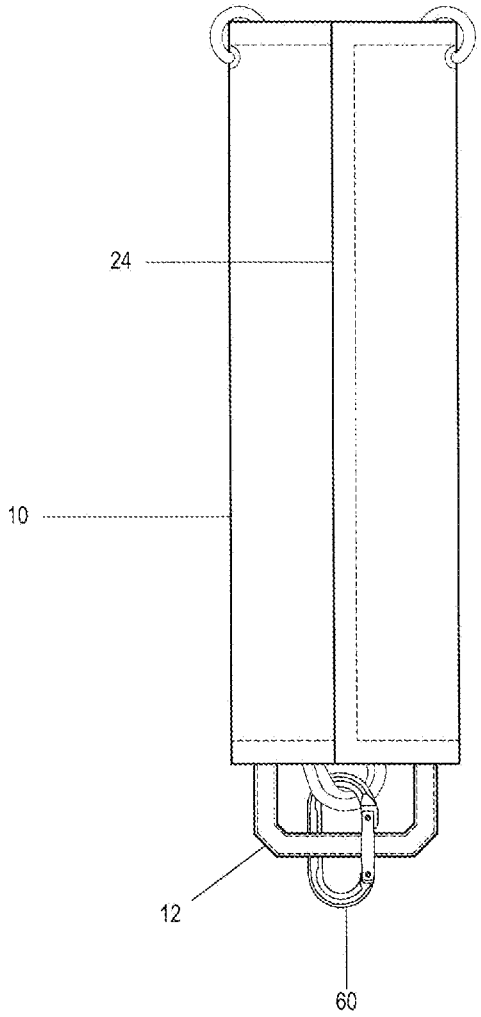
FIG. 4D illustrates the rope protecting device of FIG. 1 in a storage configuration according to certain embodiments.

FIGS. 4A, 4B, 4C, and 4D show a rope protecting device 100 that has been disconnected from a load-bearing rope and is in its storage configuration. Primary rope connector assembly 16 and gate clips 18 and 40 are placed on the sheath 10. FIGS. 4C and 4D show a gate clip 60 added to the assembly to secure the assembly 20 to the handle 12 for storage purposes. It will be appreciated that the ability to securely wrap the device into a compact configuration as is shown is a significant benefit, enabling the device to be conveniently stored on the person of the user during a climbing or rappelling event, for example. This ability to conveniently disengage the device from the load-bearing rope and wrap it into its storage configuration enables the user to thereafter again deploy the device at different locations during a single event.

The rope protecting device 100 illustrated in FIG. 1 protects a variety of rope types, generally referred to as "climbing ropes" or "primary ropes." As used herein, "climbing ropes" or "primary ropes" include rappelling ropes, climbing ropes and support ropes for use on mountains, cliffs, hills, buildings, scaffolds and other structures. As used herein, climbing refers to upward movement, downward movement, horizontal movement, and rappelling.

The intended method of use of the device 100 illustrated in FIG. 1 is for the protection of climbing ropes during use in close proximity to or direct contact with sharp or abrasive edges or surfaces. The device 100 is secured to the load-bearing rope using a knot that will allow the user to position the device 100 axially along the rope, but also allow cinching down of the knot to fix the device 100 in a position along the axis of the rope 50. The position of the device 100 along the axis of the rope 50 is determined by the user by determining where the rope 50 will contact a sharp or abrasive edge or surface and placing the knot so the protective sheath 10 will provide a barrier between the load-bearing rope 50 and the identified sharp or abrasive edge or surface. The flexible sheath 10 is opened by separating edges 24 and 26 by unfastening of fastener halves 32 and 34 and positioned adjacent to the load-bearing rope 50 with the ends 28 and 30 perpendicular to the axis of the load-bearing rope 50. The sheath 10 is then wrapped around the load-bearing rope in a way so that edges 24 and 26 are brought to an overlapping position that allows the fastener halves 32 and 34 to be secured to each other, closing the sheath 10 and forming a protective sleeve around the load-bearing rope 50.

Final position adjustment of the rope protecting device 100 illustrated in FIG. 1 along the axis of the load-bearing rope 50 is made by loosening the securing knot 46 and sliding it along the load-bearing rope 50. Final securing of the position of the device 100 is accomplished by cinching the knot 46 in a way that will properly prevent the knot from sliding along the axis of the load-bearing rope 50. The user will then, upon initial decent from the area in which they wish to descend, grasp the load-bearing rope 50 and handle 12 of the device 100 with the same hand, lifting the rope off of the sharp or abrasive edge or surface, and ensure that as the user continues to descend along the load-bearing rope 50 that the device remains positioned in a way to create a protective barrier between a load-bearing rope 50 and an edge. Once the user has descended to a point where they cannot grasp the handle 12, the handle 12 is released, leaving the device properly positioned.

Second Embodiment

Figure 5:
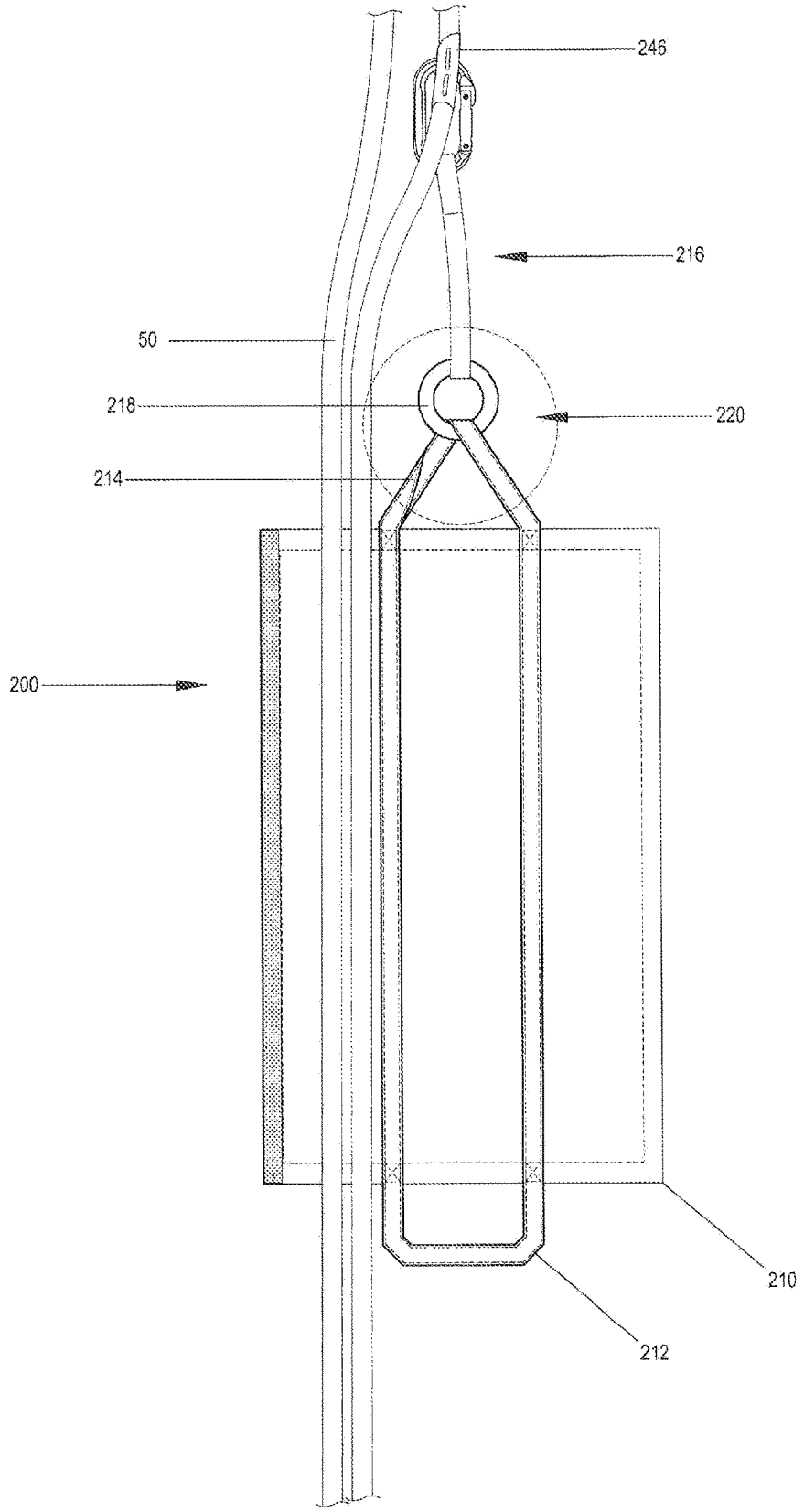
FIG. 5 illustrates a second embodiment of a rope protector device.

As shown in FIG. 5, the rope protecting device 200 comprises a flexible sheath 210, a handle 212, a sheath connector assembly 220 and a primary rope connector assembly 216.

Figure 6A:
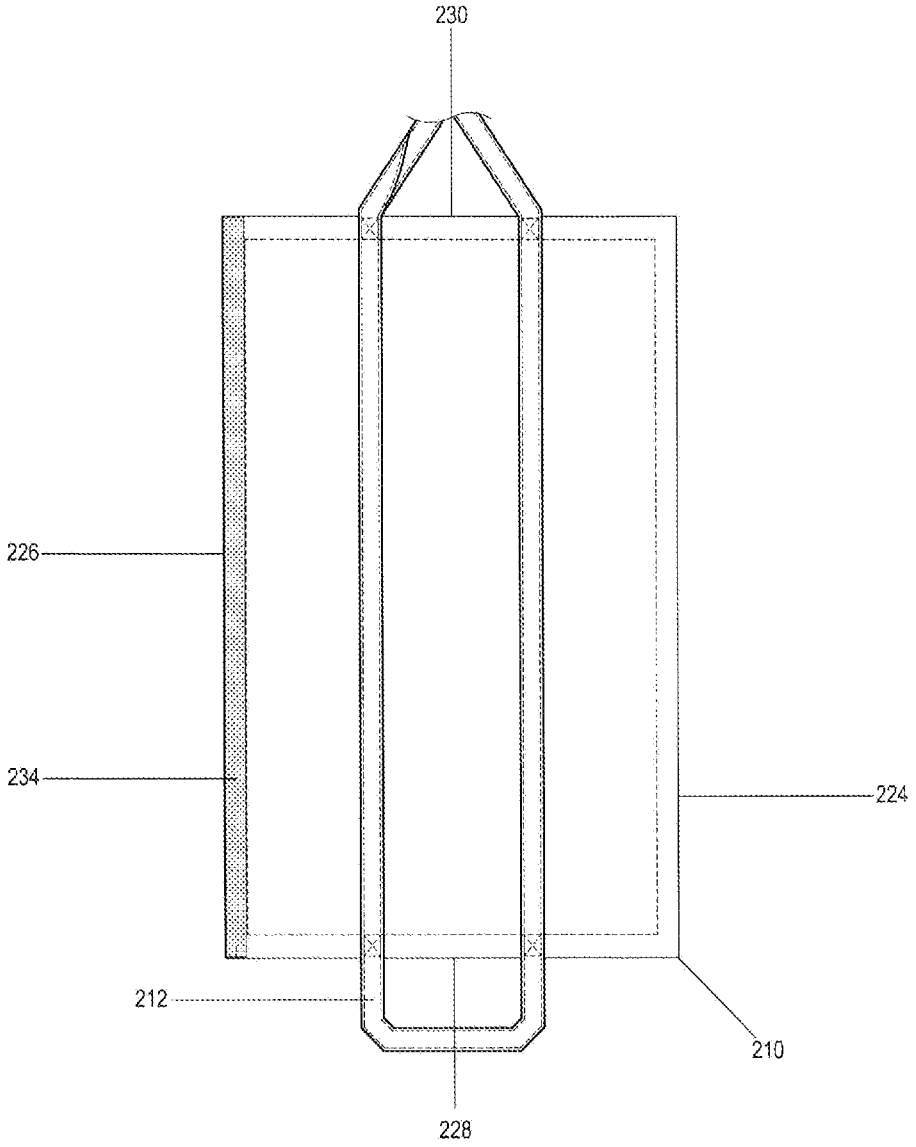
FIG. 6A illustrates the surface of the open sheath component of the rope protecting device that contacts the load-bearing rope.

As can be seen in FIG. 6A, the flexible sheath 210 in its open position has a generally rectangular configuration with edges 224 and 226 generally opposed to each other. The flexible sheath 210 is preferably fabricated from a durable, abrasion resistant material. Non-limiting examples of materials used for construction of the sheath include, but are not limited to, natural leather, synthetic leather, and durable synthetic and/or natural polymeric material. Non-limiting examples of durable polymeric material include nylon, nylon/cotton blends, and nylon blended with natural fibers. One particularly useful type of material is sold by Invista under the trade name CORDURA. A non-limiting example of a suitable leather material is such as is available from Tandy Leather Factory as PN 9070-02 Stoned oil side—4/4.5 oz.—dark brown.

Edges 224 and 226 shown in FIG. 6A comprise a fastener including a first fastener component 232 and a second fastener component 234 enabling at least a portion of the length of the edges 224 and 226 to be detachably attached to each other. The fastener components 232 and 234 are preferably individually halves of a fastening tape that when used together allow closure for ease of use, although other closing mechanisms can be utilized as are known in the art for attaching and detaching at least a portion of the opposing edges 224 and 226 of the flexible sheath 210. Non-limiting examples of closure devices are buttons, snaps, zippers, hook and eye fasteners or magnetic fasteners. Flexible sheath 210 should be flexible enough to provide an opening large enough for a load bearing rope to pass through the opening created when the fastener components 232 and 234 are disengaged and the edges 224 and 226 are not attached to each other.

FIG. 6A further illustrates first sheath end 228 and second sheath end 230 of the flexible sheath 210. Ends 228 and 230 are generally opposed to each other. A handle 212 is attached at first sheath end 228, and is preferably fabricated from a durable climbing material such as 11/16" wide tubular webbing such that available from Sterlingrope.com, part no. WB174NY_091 and is secured to the sheath by sewing or any other method known in the art for joining fabric or flexible materials either temporarily or permanently. Other materials comparable to the aforementioned webbing may be used to construct the handle without deviating from the intended construction of this embodiment. The handle 212 is useful in the operation of the rope protector assembly 200 by allowing the user to pass their hand through the handle while allowing the primary rope to pass through this same hand promoting safe rappelling practices by allowing the rappeler to maintain constant contact with the main climbing rope while positioning and releasing the rope protecting device during the rappel. Further, the handle 212 is also useful in storing the rope protector assembly 200 when not in use. In the embodiment shown in FIG. 6A, the handle 212 is formed from webbing that is stitched to the sheath 210 along the length of the sheath 210 on the inside of the sheath 210, i.e. the side of the sheath that contacts the climbing ropes. In embodiments, the handle can be stitched to the outer side of the sheath 210.

Figure 6B:
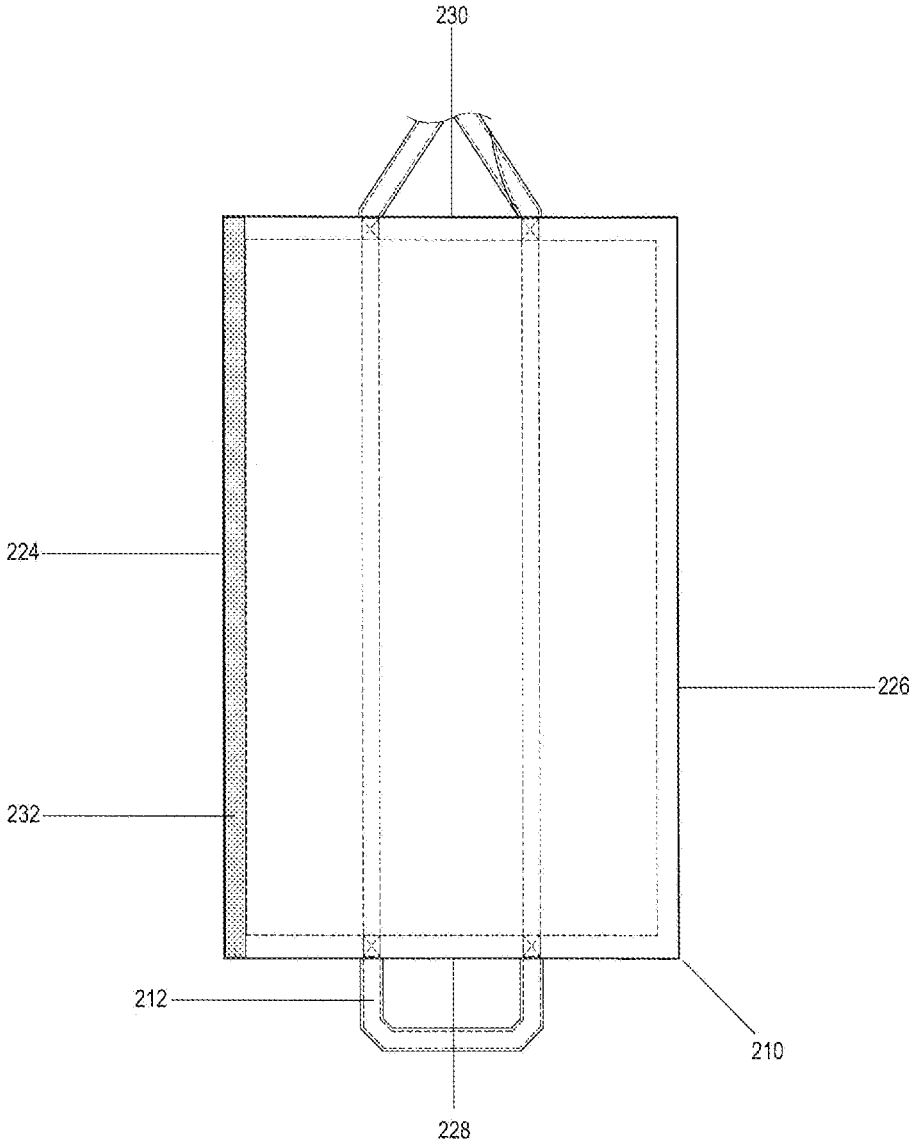
FIG. 6B illustrates the surface of the open sheath component of the rope protecting device that contacts an edge to be protected against.

FIG. 6B illustrates the flexible sheath 210 in an alternate view. The flexible sheath 210 is in an open position with what is the external face when the flexible sheath is closed facing up. The external face is the surface that is intended to come into contact with abrasive or sharp surfaces or edges when the device is used as intended. Sheath edges 224 and 226 are configured to be attached to each other using fastener components 232 and 234 (see FIG. 6A).

Figure 7:
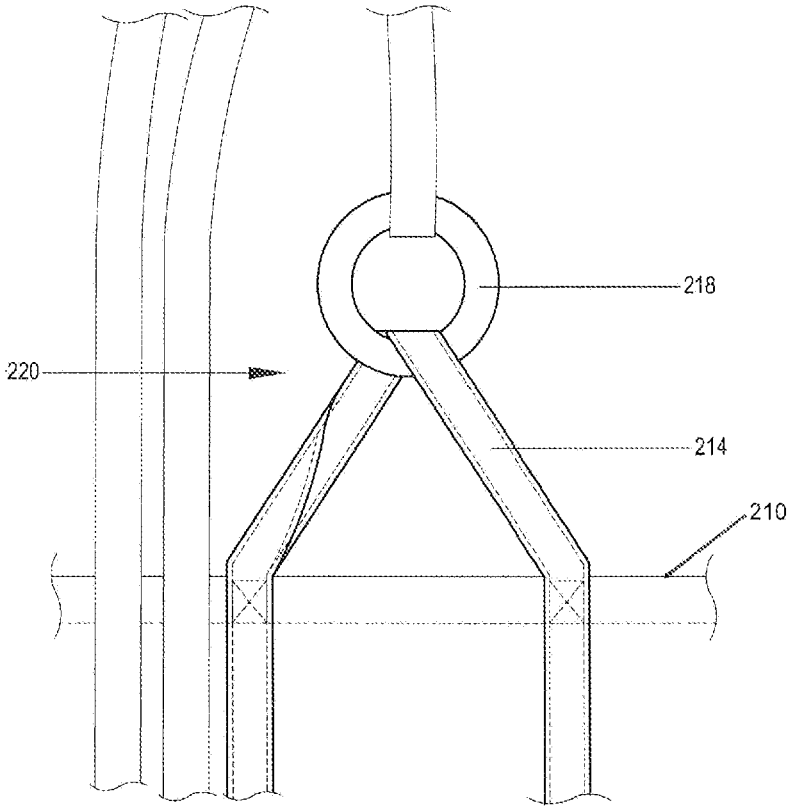
FIG. 7 illustrates a sheath connector assembly that attaches to the sheath of the rope protector device of FIGS. 6A and 6B.

FIG. 7 illustrates a sheath connector assembly 220. As shown in FIG. 7, the sheath connector assembly 220 of this embodiment comprises a single strap 214 of webbing passed through the ring 218 and sewn to the flexible sheath 210. The strap 214 extends outwardly from the first sheath end 230. A non-limiting example of suitable material for this strap is 11/16" wide tubular webbing such that available from Sterlingrope.com, part no. WB174NY_091. The strap 214 may be attached to the flexible sheath by any other method known to the art to secure the strap 214 to the flexible sheath 210 either temporarily or permanently. In embodiments, the strap 214 is made from the same material as the handle 212 and may be formed from the same continuous elongated segment of webbing that is used to form the handle 212. The sheath connector assembly 220 further comprises at least one durable ring 218 such as is available from Omega Pacific, product no. RAPRNG. Rings of any enclosed shape may be used. Any ring of suitable construction to support the weight of a commonly equipped and situated climber, not limited by material or shape, may be used. In the embodiment shown in FIG. 7, one ring 218 is used but more than one may be used.

Figure 8:
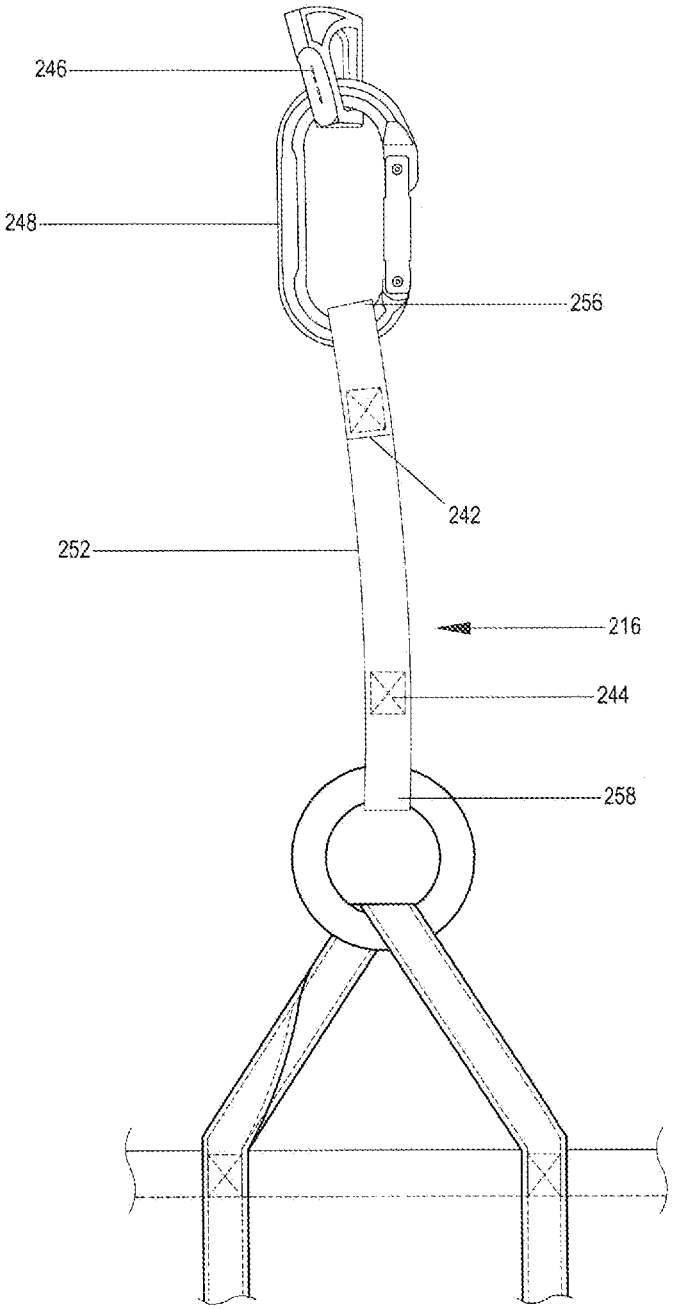
FIG. 8 illustrates a primary rope connector assembly that attaches to both the sheath connector assembly and to the primary rope according to the rope protector device of FIGS. 6A and 6B.

FIG. 8 shows a primary rope connector assembly 216. The primary rope connector assembly 216 of this embodiment comprises one strap 252, one gate clip 248, and a device positioner such as the rope-gripping device 246 shown in FIG. 8. The strap 252 comprises a single strap with first end 242 and second end 244. The strap 252 is formed by sewing first end 242 to the strap 252 to form a loop 256 suitable in size to allow the gate clip 248 to easily be passed through the loop 256 by the user of the device. As illustrated in FIG. 8 the strap 252 is attached to the durable ring 218 by way of passing the second end 244 through the durable ring 218 and sewing the strap to itself forming a loop 258 that will hold the durable ring 218 captive. In embodiments, the ring 218 is a support ring having a construction sufficient to support the connection between the strap 214 and the strap 252.

As used herein, "gate clip" includes carabiners, both locking and non-locking, or any other ring-type device that has a movable gate feature that allows a strap or rope to be passed through the gate and into the ring from a radial direction in relation to the ring.

FIG. 8 further illustrates the gate clip 248 is attached to the rope gripping device 246 by passing the gate clip 248 through a hole in the rope gripping device 246. A non-limiting example of a rope gripping device 246 is a TIBLOC ascending device, reference no. B01 as available from Petzl. Other devices that non-permanently securely grip or attach themselves to a climbing rope, allow for the attachment of a carabiner 248, and are suitable to support the weight of a commonly equipped and situated climber commonly known to the art may be used without deviating from the illustrated embodiment.

Figure 9A:
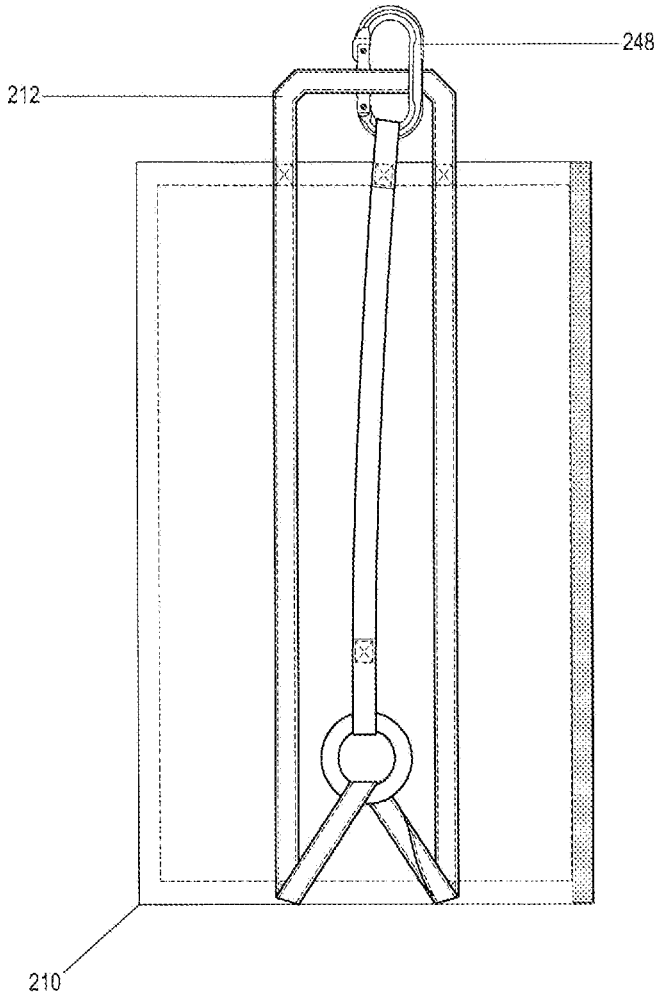
FIG. 9A illustrates the sheath component of the rope protecting device shown in FIGS. 6A and 6B open to show the position of the primary rope connector assembly when the rope protecting device of FIGS. 6A and 6B is in the storage configuration.
Figure 9B:
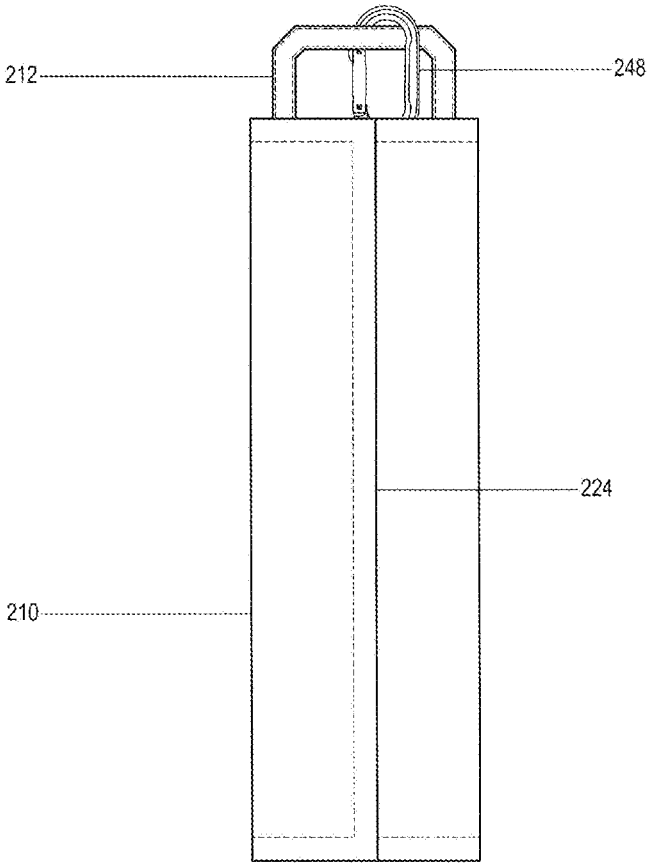
FIG. 9B illustrates the rope protecting device of FIGS. 6A and 6B in a storage configuration according to certain embodiments.

FIGS. 9A and 9B show the rope protecting device 200 that has been disconnected from a load-bearing rope and is in its storage configuration. As illustrated in FIGS. 9A and 9B the rope-gripping device 246 is removed from the device, although it also may be left connected to gate clip 248 in this storage configuration. FIGS. 9A and 9B show the gate clip 248 passed through the handle 212 to secure the assembly 220 to the handle 212 for storage purposes. It will be appreciated that the ability to securely wrap the device into a compact configuration as is shown is a significant benefit, enabling the device to be conveniently stored on the person of the user during a climbing event for example. This ability to conveniently disengage the device from the load-bearing rope and wrap it into its storage configuration enables the user to thereafter again deploy the device at different locations during a single event.

The rope protecting device 200 illustrated in FIG. 5 protects a variety of rope types, generally referred to as "climbing ropes."

The intended method of use of the rope protecting device 200 illustrated in FIG. 5 is for the protection of climbing ropes during use in close proximity to or direct contact with sharp or abrasive edges or surfaces. The device 200 is secured to the load-bearing rope using a rope-gripping device 246 that will allow the user to freely position the device 200 axially along the rope, but also allow the user to easily fix the device 200 in a position along the axis of the rope 50. The position of the device 200 along the axis of the rope 50 is determined by the user by determining where the rope 50 will contact a sharp or abrasive edge or surface and placing the rope gripping device 246 so the protective sheath 210 will provide a barrier between the load-bearing rope 50 and the identified sharp or abrasive edge or surface. The flexible sheath 210 is opened by separating edges 224 and 226 by unfastening of fastener components 232 and 234 and the flexible sheath 210 is then positioned adjacent to the load-bearing rope 50 with the ends 228 and 230 perpendicular to the axis of the load-bearing rope 50. The sheath 210 is then wrapped around the load-bearing rope in a way so that edges 224 and 226 are brought to an overlapping position that allows the fastener halves 232 and 234 to be secured to each other, closing the sheath 210 and forming a protective sleeve around the load-bearing rope 50.

Final position adjustment of the device 200 along the axis of the load-bearing rope 50 is made by releasing the mechanism of the rope-gripping device 246 so that it may be easily slid along the load-bearing rope 50. Final securing of the position of the device 200 is accomplished by engaging the rope-gripping device 246 in a way that will properly prevent the rope-gripping device 246 from sliding along the axis of the load-bearing rope 50. The user will then, upon initial decent from the area in which they wish to descend, grasp the load-bearing rope 50 and handle 212 of the device 200 with the same hand, lifting the rope off of the sharp or abrasive edge or surface, and ensure that as the user continues to descend along the load-bearing rope 50 that the device remains positioned in a way to separate the load-bearing rope 50 from the sharp or abrasive edge or surface. Once the user has descended to a point where they cannot grasp the handle 212, the handle 212 is released, leaving the device properly positioned.

Third Embodiment

Figure 10:
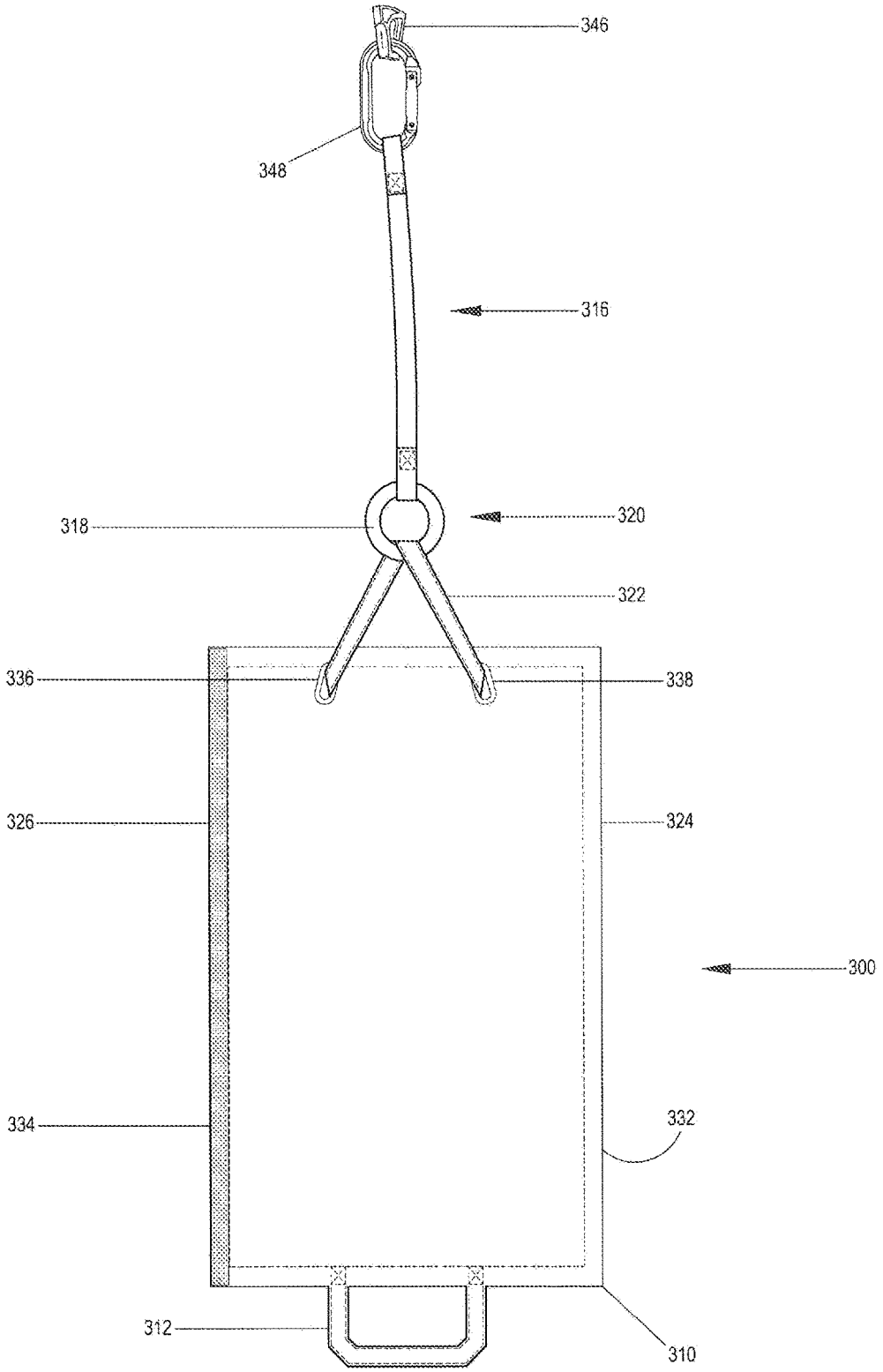
FIG. 10 illustrates a third embodiment of a rope protector device.

As shown in FIG. 10, the rope protecting device 300 comprises a flexible sheath 310, a handle 312, a sheath connector assembly 320 and a primary rope connector assembly 316.

As can be seen in FIG. 10, the flexible sheath 310 in its open position has a generally rectangular configuration with edges 324 and 326 generally opposed to each other. The flexible sheath is preferably fabricated from a durable, abrasion resistant material. Non-limiting examples of materials used for construction of the sheath include, but are not limited to, natural leather, synthetic leather, and durable synthetic and/or natural polymeric material. Non-limiting examples of durable polymeric material include nylon, nylon/cotton blends, and nylon blended with natural fibers. One particularly useful type of material is sold by Invista under the trade name CORDURA. A non-limiting example of a suitable leather material is such as is available from Tandy Leather Factory as PN 9070-02 Stoned oil side—4/4.5 oz.—dark brown.

Edges 324 and 326 comprise a fastener including a first fastener component 332 and a second fastener component 334 enabling at least a portion of the length of the edges 324 and 326 to be detachably attached to each other. The fastener components 332 and 334 are preferably individually halves of a fastening tape that when used together allow closure for ease of use, although other closing mechanisms can be utilized as are known in the art for attaching and detaching at least a portion of the opposing edges 324 and 326 of the flexible sheath 310. Non-limiting examples of closure devices are buttons, snaps, zippers, hook and eye fasteners or magnetic fasteners. Flexible sheath 310 should be flexible enough to provide an opening large enough for a load bearing rope to pass through the opening created when the fastener components 332 and 334 are disengaged and the edges 324 and 326 are not attached to each other.

FIG. 10 further illustrates first sheath end 328 and second sheath end 330 of the flexible sheath 310. Ends 328 and 330 are generally opposed to each other. A handle 312 is attached at first sheath end 328, and is preferably fabricated from the same material the flexible sheath 310 is, but it is not required that the handle 312 and flexible sheath 310 be constructed of the same material. The handle 312 is secured to the sheath by sewing or any other method known in the art for joining fabric or flexible materials. Other materials suitable for supporting a commonly equipped and situated climber may be used to construct the handle without deviating from the intended construction of this embodiment. The handle 312 is useful in the operation of the rope protecting device 300 by allowing the user to pass his hand through the handle while allowing the primary rope to pass through this same hand promoting safe rappelling practices by allowing the rappeler to maintain constant contact with the main climbing rope while positioning and releasing the rope protecting device during the rappel. Further, the handle 312 is also useful in storing the rope protector assembly 300 when not in use.

In the embodiment shown in FIG. 10, the handle 312 is formed from material that is stitched to the sheath 310 on the inside surface of the flexible sheath 310, i.e. the side of the sheath that contacts the climbing ropes. A sheath reinforcement strap 313 extends from edge 324 to edge 326 on the inner side of the sheath 310 and is also stitched to the sheath 310, overlapping the portion of the handle 312 that is stitched to the sheath 310. The reinforcement strap 313 may be a piece of material separate from the flexible sheath material 310, secured to the flexible sheath 310 or the reinforcing strap 313 may be a piece of the flexible sheath 310 folded over and secured with stitching or other means. In alternate embodiments, the handle can be stitched to the outer side of the sheath 310.

FIG. 10 further illustrates at least two grommets 336 and 338 positioned proximate the second sheath end 330. The configuration of the grommets will depend on the nature of the sheath connector assembly 320 as will be more fully disclosed herein.

FIG. 10 illustrates a sheath connector assembly 320 where the sheath 310 is in the open position, with sheath edges 324 and 326 separate from each other. As shown in FIG. 10, the sheath connector assembly 320 of this embodiment comprises one strap 322 of material and a durable ring 318. An end portion of strap 322 is passed through the durable ring 318 then is passed through the grommets 336 and 338 and sewn to strap 322 forming a closed loop strap 322 that is secured to the flexible sheath 310 and the durable ring 318. The sheath connector assembly 320 may comprise one or more straps without deviating from the embodiment herein as seen after stitching. A non-limiting example of suitable material for strap 322 is 11/16" wide tubular webbing such that available from Sterlingrope.com, part no. WB174NY_091. The strap 322 may be attached to the flexible sheath by any other method known to the art to secure the strap 322 to the flexible sheath 310 so that it may support the weight of a climber. The sheath connector assembly 320 further comprises at least one durable ring 318 such as is available from Omega Pacific, product no. RAPRNG. Rings of any enclosed shape may be used. Any ring of suitable construction to support the weight of a commonly equipped and situated climber, not limited by material or shape, may be used. In the embodiment shown in FIG. 10, one ring 318 is used, but more than one may be used.

FIG. 10 shows a primary rope connector assembly 316. The rope connector assembly 316 of this embodiment comprises one strap 352, one gate clip 348, and a device positioner such as the rope-gripping device 346 shown in FIG. 10. The strap 352 comprises a single strap with first end 350 and second end 344. The strap 352 is formed by sewing first end 350 to the strap to form a loop suitable in size to allow the gate clip 348 to easily be passed through the loop by the user of the device. As illustrated in FIG. 10 the strap 352 is attached to the durable ring 318 by way of passing the second end 344 through the durable ring 318 and sewing the strap to itself forming a loop that will hold the durable ring 318 captive.

FIG. 10 further shows that the gate clip 348 is attached to the rope gripping device 346 by passing the gate clip 348 through a hole in the rope gripping device 346. A non-limiting example of a rope gripping device 346 is a TIBLOC ascending device, reference no. B01 as available from Petzl. Another suitable rope gripping device is a MICRO TRAXION Ref. No. P53 available from Petzl. Other devices that non-permanently securely grip or attach themselves to a climbing rope, allow for the attachment of a gate clip 348, and are suitable to support the weight of a commonly equipped and situated climber commonly known to the art may be used without deviating from the illustrated embodiment.

Figure 11A:
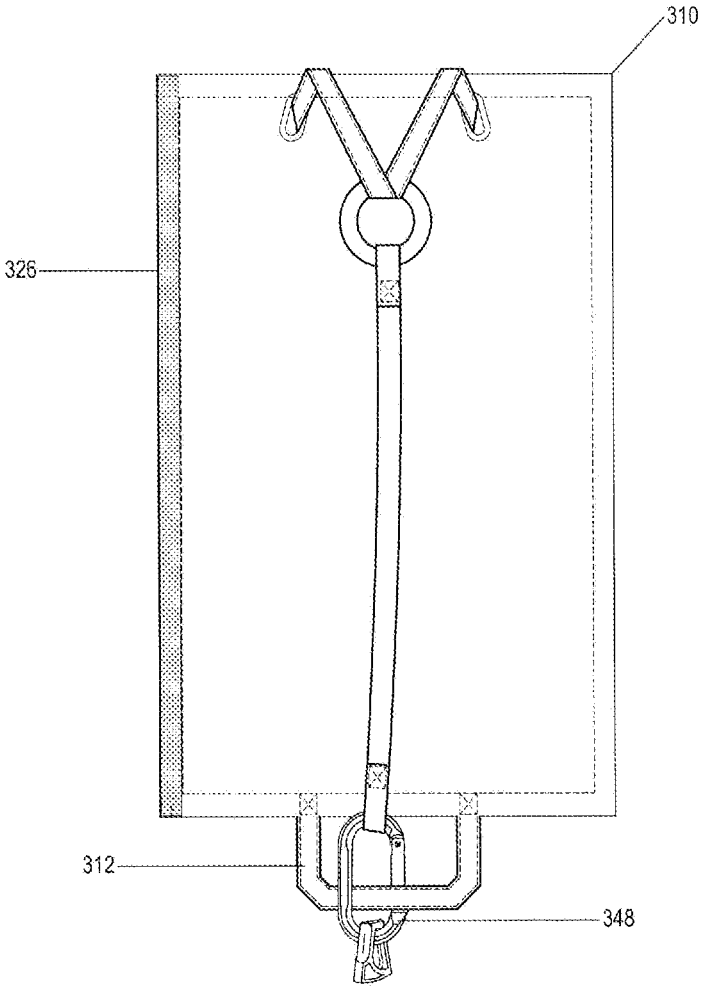
FIG. 11A illustrates the sheath component of the rope protecting device shown in FIG. 10 open to show the position of the primary rope connector assembly when the rope protecting device of FIG. 10 is in the storage configuration.
Figure 11B:
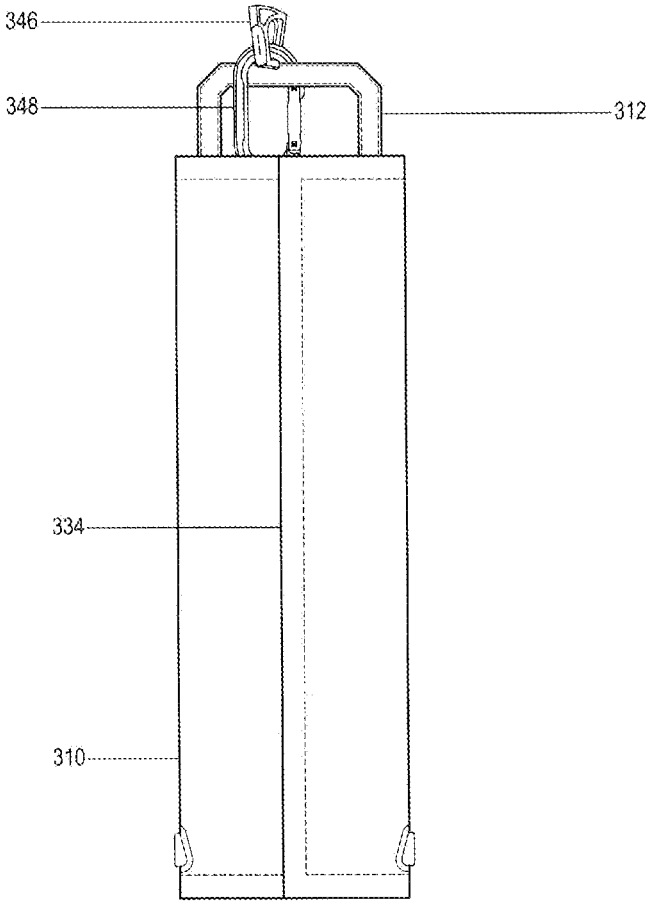
FIG. 11B illustrates the rope protecting device of FIG. 10 in a storage configuration according to certain embodiments.
Figure 11C:
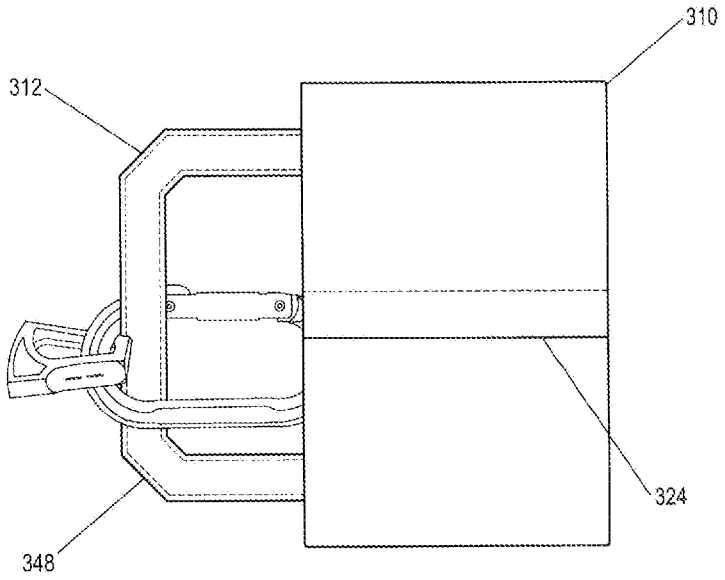
FIG. 11C illustrates the rope protecting device of FIG. 10 in a rolled storage configuration.

FIGS. 11A and 11B show the rope protecting device 300 that has been disconnected from a load-bearing rope and is in its storage configuration. As illustrated in FIGS. 11A and 11B the rope-gripping device 346 can be removed from the device 300, but alternatively may be left connected to gate clip 348 in this storage configuration. FIGS. 11A and 11B show the gate clip 348 passed through the handle 312 to secure the assembly 320 to the handle 312 for storage purposes. It will be appreciated that the ability to securely wrap the device into a compact configuration as is shown is a significant benefit, enabling the device to be conveniently stored on the person of the user during a climbing event for example. This ability to conveniently disengage the device from the load-bearing rope and wrap it into its storage configuration enables the user to thereafter again deploy the device at different locations during a single event. FIG. 11C shows the device in a rolled storage position.

Non-limiting examples of a suitable rope-gripping device are Tibloc, Ref. No. B01 available from Petzl, device has internal teeth that grip a climbing rope. Another type of rope-gripping device, known as a Micro Traxion device, Ref. No. P53, is available from Petzl. This device also has internal teeth that grip the climbing rope.

The rope protecting device 300 illustrated in FIG. 10 protects a variety of rope types, generally referred to as "climbing ropes."

In embodiments, the sheath is rectangular, but also can be of other shapes. In some embodiments, the sheath has a length in the range of about 12 inches to about 24 inches, and a width of about 7 to about 14 inches.

The intended method of use of the rope protecting device 300 illustrated in FIG. 10 is for the protection of climbing ropes during use in close proximity to or direct contact with sharp or abrasive edges or surfaces. The device 300 is secured to the load-bearing rope using a rope-gripping device 346 that will allow the user to freely position the device 300 axially along the rope, but also allow the user to easily fix the device 300 in a position along the axis of the rope 50. The position of the device 300 along the axis of the rope 50 is determined by the user by determining where the rope 50 will contact a sharp or abrasive edge or surface and placing the rope gripping device 346 so the protective sheath 310 will provide a barrier between the load-bearing rope 50 and the identified sharp or abrasive edge or surface. The flexible sheath 310 is opened by separating edges 324 and 326 by unfastening of fastener components 332 and 334 and positioned adjacent to the load-bearing rope 50 with the ends 328 and 330 perpendicular to the axis of the load-bearing rope 50. The sheath 310 is then wrapped around the load-bearing rope in a way so that edges 324 and 326 are brought to an overlapping position that allows the fastener halves 332 and 334 to be secured to each other, closing the sheath 310 and forming a protective sleeve around the load-bearing rope 50.

Final position adjustment of the rope protecting device 300 illustrated in FIG. 10 along the axis of the load-bearing rope 50 is made by releasing the mechanism of the rope-gripping device 346 so that it may be easily slid along the load-bearing rope 50. Final securing of the position of the device 300 is accomplished by engaging the rope-gripping device 346 in a way that will properly prevent the rope-gripping device 346 from sliding along the axis of the load-bearing rope 50. The user will then, upon initial decent from the area in which they wish to descend, grasp the load-bearing rope 50 and handle 312 of the device 300 with the same hand, lifting the rope off of the sharp or abrasive edge or surface, and ensure that as the user continues to descend along the load-bearing rope 50 that the device remains positioned in a way to separate the load-bearing rope 50 from the sharp or abrasive edge or surface. Once the user has descended to a point where they cannot grasp the handle 312, the handle 312 is released, leaving the device properly positioned.

General Method of Manufacturing the Device

The device herein described can generally be made by the following process:

Flexible sheath fabrication is achieved by cutting a piece of durable, abrasion resistant, flexible material to size. Two mating components of a fastening device must be affixed to two of the opposing edges of the flexible sheath material to allow joining the two opposing edges and forming a cylinder-like shape with the flexible sheath material.

If grommets are required to connect the sheath connector assembly to the flexible sheath appropriately shaped holes must be made in the sheath material close to one of the edges and the grommets inserted into the holes and secured.

The handle is fabricated by cutting a strip of durable material to an appropriate length and securing it to the edge of the flexible sheath opposite the edge containing grommets or the edge intended to be secured to the sheath connector assembly.

The sheath connector assembly is fabricated by cutting at least one piece of rope or strap and securing it to the section of the flexible sheath near the edge opposite the edge with the handle. A durable ring or gate clip is secured to the end of the sheath connector assembly opposite the flexible sheath. Alternatively, the handle and sheath connector straps may be fabricated from one piece of material by cutting it long enough to produce a handle at one end of the sheath, to be stitched along the length of the sheath, form another loop at the other end of the sheath suitable to produce a portion of the sheath connector assembly, and to be stitched along the sheath again to meet the first end of the handle material.

The main rope connector assembly is fabricated by cutting a strap or rope to an appropriate length and securing one end to the durable ring or gate clip of the sheath connector assembly. The other side of the strap or rope is formed to accept hardware for attaching to the main rope or tied in a knot to allow tying to the main rope.

If the end of the rope or strap of the rope connecting assembly has been formed to accept rope gripping hardware it is installed.

A number of alternatives, modifications, variations, or improvements may be subsequently made by those skilled in the art, which are intended to be encompassed by the following claims.

What is claimed is:

1. A device for protecting a climbing rope comprising:

a flexible sheath comprising a first edge, a second edge generally opposing the first edge, a first end, and a second end generally opposing the first end;

a sheath connector assembly attached at the second end of the flexible sheath, the sheath connector assembly comprising at least one strap and a ring, the strap securely attached to the sheath so as to form a loop that passes through the ring; and a primary rope connector assembly attached to the sheath connector assembly, the primary rope connector assembly comprising at least one device positioner.

2. The device of claim 1, wherein the flexible sheath further comprises a handle positioned proximate said first end.

3. The device of claim 2, wherein the flexible sheath further comprises at least two grommets proximate said second end.

4. The device of claim 1, wherein the flexible sheath further comprises a fastener disposed along at least a portion of said first and second edges for detachably attaching said first and second edges together.

5. An assembly comprising a load-bearing rope and the device of claim 1.

6. A method of making the device of claim 1.

7. The device of claim 1, wherein the device positioner comprises a prusik knot.

8. A device for protecting a climbing rope comprising:

a flexible sheath comprising a first edge, a second edge generally opposing the first edge, a first end, and a second end generally opposing the first end;

a sheath connector assembly attached at the second end of the flexible sheath; and a primary rope connector assembly attached to the sheath connector assembly, the primary rope connector assembly comprising at least one device positioner, wherein the primary rope connector assembly comprises a first gate clip, a rope connecting strap connecting the first gate clip to the ring, and a rope gripping device connected to the first gate clip and being configured to grip a primary rope.

9. The device of claim 8, wherein the flexible sheath further comprises a fastener disposed along at least a portion of said first and second edges for detachably attaching said first and second edges together.

10. The device of claim 9, wherein the fastener comprises fastening tape.

11. The device of claim 8, wherein the device positioner comprises a prusik knot.

12. A device for protecting a climbing rope comprising:

a flexible sheath comprising a first edge, a second edge generally opposing the first edge, a first end, and a second end generally opposing the first end;

a sheath connector assembly attached at the second end of the flexible sheath; and a primary rope connector assembly attached to the sheath connector assembly, the primary rope connector assembly comprising at least one device positioner which includes a rope gripping device.

* * * * *